US009115890B2

(12) United States Patent
Zagoroff

(10) Patent No.: US 9,115,890 B2
(45) Date of Patent: Aug. 25, 2015

(54) IGNITION SYSTEM FOR PORTABLE LPG BURNER

(75) Inventors: Dimiter S. Zagoroff, Lincoln, MA (US); Polly Drinkwater, legal representative, Lincoln, MA (US)

(73) Assignees: Polly B. Drinkwater, Lincoln, MA (US); AFGlobal Corporation, Houston, TX (US)

( * ) Notice: Subject to any disclaimer, the term of this patent is extended or adjusted under 35 U.S.C. 154(b) by 663 days.

(21) Appl. No.: 13/108,591

(22) Filed: May 16, 2011

(65) Prior Publication Data

US 2011/0217662 A1 Sep. 8, 2011

Related U.S. Application Data

(63) Continuation of application No. PCT/US2009/064807, filed on Nov. 17, 2009.

(60) Provisional application No. 61/199,541, filed on Nov. 18, 2008.

(51) Int. Cl.
*F23Q 3/00* (2006.01)
*B23P 19/00* (2006.01)
(Continued)

(52) U.S. Cl.
CPC ..... *F23D 14/465* (2013.01); *F23D 14/38* (2013.01); *F23Q 3/002* (2013.01); *F23D 2207/00* (2013.01); *F23D 2213/00* (2013.01); *Y10T 29/49826* (2015.01)

(58) Field of Classification Search
CPC . F23Q 3/002; F23D 2207/00; F23D 2213/00; F23D 14/465; F23D 14/38
USPC ..... 431/158, 264, 265, 266, 345, 354; 126/21 A, 414, 401, 217
See application file for complete search history.

(56) References Cited

U.S. PATENT DOCUMENTS 2,659,796 A * 11/1953 Anderson ..... 219/137.9
3,187,154 A * 6/1965 Stepath ..... 219/70
(Continued)

FOREIGN PATENT DOCUMENTS

EP 0841518 A2 5/1998
FR 2751053 A1 1/1998
(Continued)

OTHER PUBLICATIONS

International Search Report and the Written Opinion of the International Searching Authority for mailed on May 24, 2012 for International Application No. PCT/US2009/064807 filed on Nov. 17, 2009.
(Continued)

*Primary Examiner* — Steven B McAllister
*Assistant Examiner* — Steven Anderson, II
(74) *Attorney, Agent, or Firm* — Hamilton, Brook, Smith & Reynolds, P.C.

(57) ABSTRACT

A gas-fired heat gun is ignited using an electrode tip located downstream of a flame holder such that the electrode tip is in the path of the flowing gas. The electrode is connected to a voltage source that causes a spark to jump from the electrode tip to another part of the heat gun, such as the flame holder or a casing of the heat gun, when a trigger is pulled, thereby igniting the flowing gas. The electrode is typically a thin wire extending through a portion of a diffuser defining a portion of the gas flow path upstream of the flame holder. The electrode may be continuous from the diffuser to a terminal end downstream of the flame holder.

9 Claims, 6 Drawing Sheets

(51) Int. Cl.
*F23D 14/46* (2006.01)
*F23D 14/38* (2006.01)

(56) References Cited

U.S. PATENT DOCUMENTS

| | | | | | |
|---|---|---|---|---|---|
| 3,917,442 | A | * | 11/1975 | Zagoroff | 431/351 |
| 4,181,492 | A | * | 1/1980 | Zinke | 431/264 |
| 4,553,927 | A | * | 11/1985 | Collins, Jr. | 431/264 |
| 4,886,446 | A | * | 12/1989 | Courrege | 431/329 |
| 5,278,392 | A | * | 1/1994 | Takacs | 219/137.43 |
| 5,344,314 | A | | 9/1994 | Zagoroff et al. | |
| 5,476,378 | A | | 12/1995 | Zagoroff et al. | |
| 6,010,329 | A | | 1/2000 | Zagoroff | |
| 6,227,846 | B1 | * | 5/2001 | Zagoroff | 431/345 |
| 2006/0019208 | A1 | * | 1/2006 | Lin | 431/153 |
| 2008/0241781 | A1 | * | 10/2008 | Sarrazi | 432/222 |

FOREIGN PATENT DOCUMENTS

| | | | | |
|---|---|---|---|---|
| FR | 2764969 | | | 12/1998 |
| FR | 2907882 | A1 | | 5/2008 |
| GB | 1463741 | A | * | 2/1977 |
| WO | WO 2007/048886 | A1 | | 5/2007 |

OTHER PUBLICATIONS

Drawings created by the inventor Dimiter S. Zagoroff (now deceased) at least by Jan. 2007, of a RIPACK shrink wrap heat gun, manufactured by Ripack-Sefrnat, Le Haillan, France.

* cited by examiner

IGNITION SYSTEM FOR PORTABLE LPG BURNER

RELATED APPLICATIONS

This application is a continuation of International Application No. PCT/US2009/064807, which designated the United States and was filed on Nov. 17, 2009, published in English, which claims the benefit of U.S. Provisional Application No. 61/199,541, filed on Nov. 18, 2008. The entire teachings of the above application are incorporated herein by reference.

BACKGROUND OF THE INVENTION

This invention relates to portable liquid propane gas (LPG) burners, which are used in a great variety of applications. One application is as a heat gun, wherein pressurized gaseous fuel aspirates air for combustion in a jet pump and the combustion products entrain additional air to create a blast of hot air. Such heat guns are commonly used to heat plastic to moderate temperatures to soften it for bending or to shrink it for packaging. To shrink wrap large objects, such as boats, it may be advantageous to lengthen the reach of the heat gun by mounting an extension between the jet pump and the burner. Thus, the ignition system for such heat guns has to be able to adapt to ignite the burner with and without an extension. Present gas-fired heat guns use a spark plug mounted at a side of a burner chamber, which may be difficult to light and also requires electrical wiring outside of the heat gun to power the spark plug. The wiring must be long enough or include couplings and extension wires to accommodate an extension. The spark plug and associated wiring add weight to the heat gun, making it harder to handle and manipulate. Also, the couplings and extension wires increase the likelihood of a short-circuit or of a failure of an electrical connection.

SUMMARY OF THE INVENTION

The present invention is an improvement for a heat gun, such as the heat gun described in U.S. Pat. No. 3,917,442 or U.S. Pat. No. 6,227,846, the contents of which are incorporated herein by reference. Rather than using a spark plug as used by prior art heat guns, embodiments of the present invention place an ignition electrode in a flame holder, which is in the flow path of the gas mixture burned by the heat gun. A voltage applied to the electrode cause a spark to jump from an electrode tip at the flame holder to a portion of the body of the heat gun. For example, the spark may jump to the surface of the burner chamber of the flame holder. The electrode may run through interior portions of the heat gun, such as a diffuser chamber to be electrically coupled to a voltage source. The electrode is electrically isolated from other portions of the heat gun by insulators. In one embodiment, a ceramic insulator having a bore therethrough is fixed to the flame holder. As the flame holder is mounted to a main housing, the igniter electrode passes through the bore with the tip of the electrode exposed beyond the insulator. The voltage source may be a piezo-electric element, a battery, or an external power source. Typically, the voltage source is actuated by a trigger mechanism. In another embodiment, an intermediate member with an electrode is placed on the electrode of the heat gun, and the electrode of the intermediate member passes through the bore of the ceramic insulator of the flame holder.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

The teachings of all patents, published applications and references cited herein are incorporated by reference in their entirety.

Figure 1:
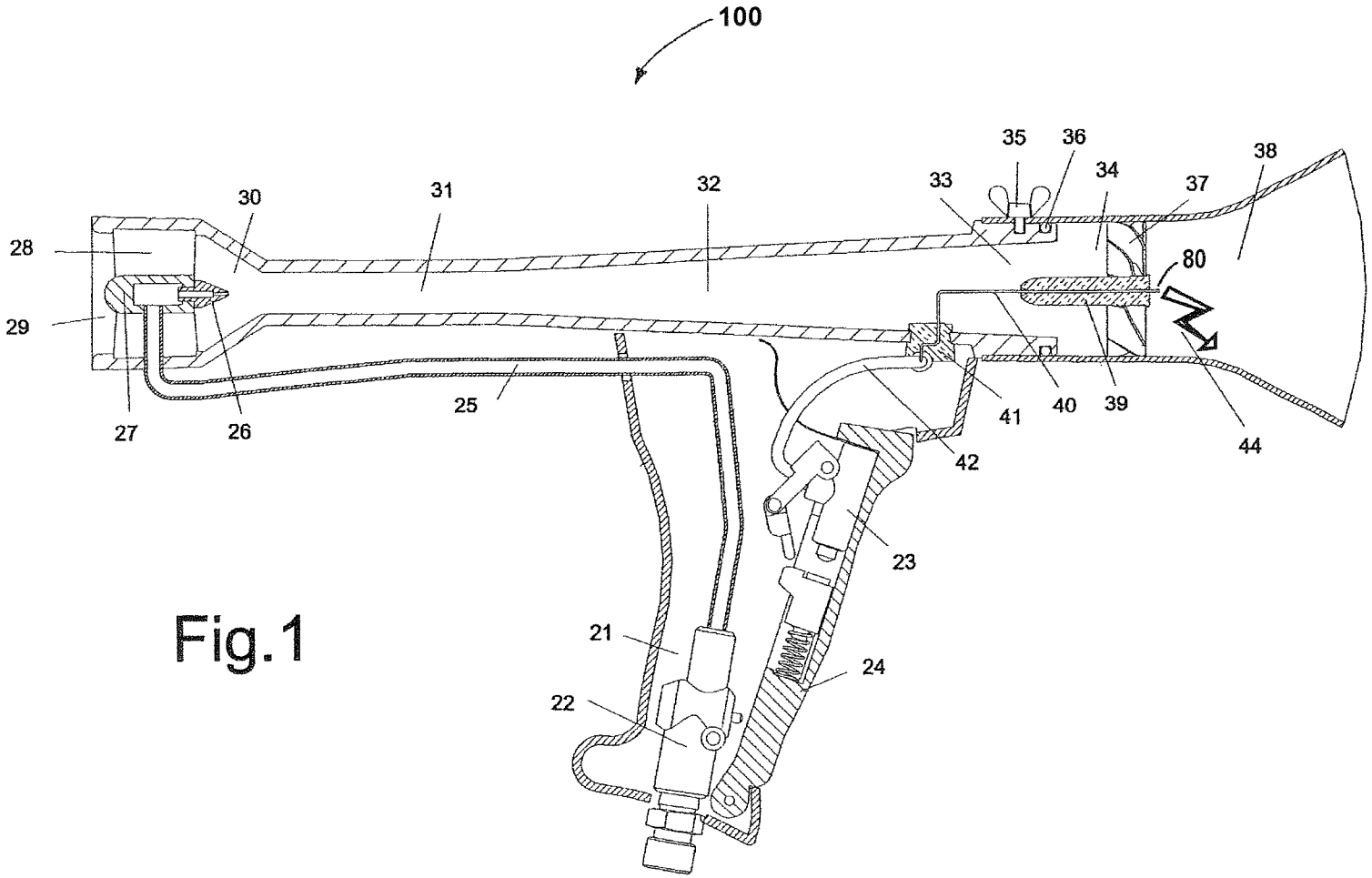
FIG. 1 is a cross-sectional side view of an embodiment of a heat gun.

FIG. 1 shows a cross-sectional view of a heat gun 100 employing an ignition system according to an embodiment of the invention. The heat gun 100 includes a handle 21, which houses a valve 22, an igniter 23 and a trigger 24. A fuel line 25 leads from the valve 22 to the jet pump nozzle 26. The jet pump nozzle 26 is located by a nozzle holder 27, which is supported by a pair of struts 28 inside the pump inlet 29. Internally, the pump contains a bell-shaped inlet 30, a cylindrical mixing section 31 and a diffuser 32. The term "diffuser, " as used herein, refers to either an expanding diffuser, such as expanding diffuser 32, or a constant cross-sectional area passageway, such as passageway 34 in FIG. 1 or extension tube 50 in FIG. 4. A burner chamber 38 with a flame holder 37 is attached to the pump outlet hub 33. The burner chamber 38 is held in place by fastener 35 and the joint is sealed by O-ring seal 36 and can be disassembled from the pump easily by removing the fastener 35.

An electrode 40 mounts inside the pump along its center axis by an insulating lead-through 41 and connects to an igniter 23 by means of the igniter lead 42. The igniter 23 may be a piezo-electric igniter that does not require an external power source. Alternatively, battery-powered igniters or igniters powered by external electrical sources may also be used. The electrode 40 fits through a bore 44 of an insulator 39 that is mounted centrally on the flame holder 37. The insulator may be an insert made of electrically insulating material, such as ceramic, as shown in FIG. 1. Alternatively, the flame holder 37 may be made of an electrically insulating material, such as ceramic, and the bore is integral to the flame holder 37. The tip 80 of electrode 40 passes through the insulator 39 and extends into the burner chamber 38 downstream of the flame holder 37.

Figure 2:
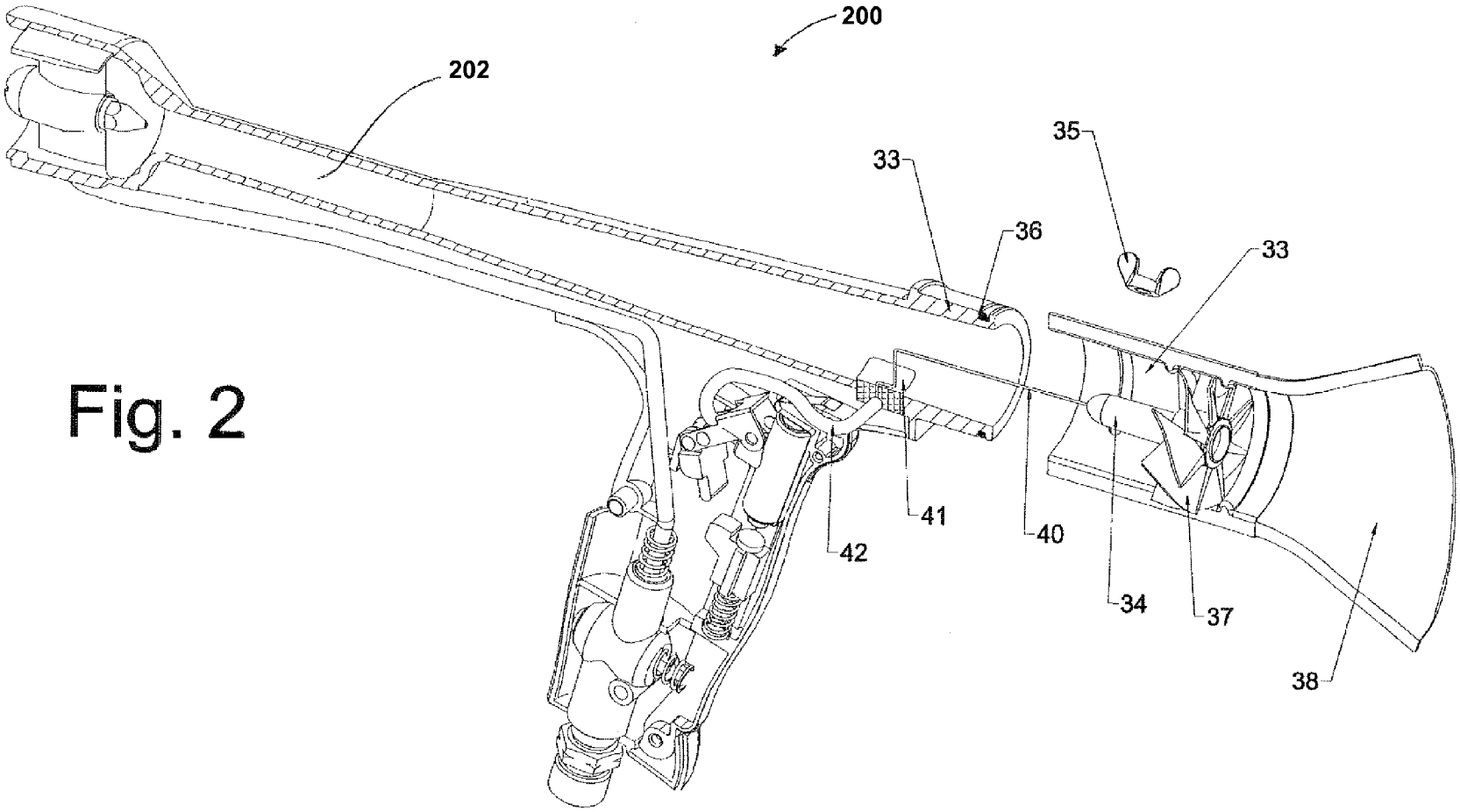
FIG. 2 is a cross-sectional exploded perspective view of an embodiment of a heat gun.

FIG. 2 shows a burner chamber 38 of an embodiment of a heat gun 200 partially disassembled from the pump 202. By unscrewing the fastener 35, the burner chamber 38 can be readily removed from o-ring seal 36. As the burner chamber 38 is removed from the pump 202 and o-ring seal 36, the electrode 40 slides out of the insulator 39. Note that FIG. 2 shows the burner chamber 38 separating from the pump 202 before the electrode 40 fully separates from the insulator 39. This feature may ease assembly because it permits inserting the electrode 40 into the bore 44 before the burner chamber 38 slips over the pump outlet 33. The insertion of the electrode 40 into the insulator bore 44 is further facilitated by the tapered insulator counter bore 45. In an alternative embodiment (not shown), the insulator 39 may be configured in the burner chamber 38 such that the burner chamber 38 interfaces with the pump 202 and o-ring seal 36 before the electrode 40 interfaces with the insulator 39.

Figure 3:
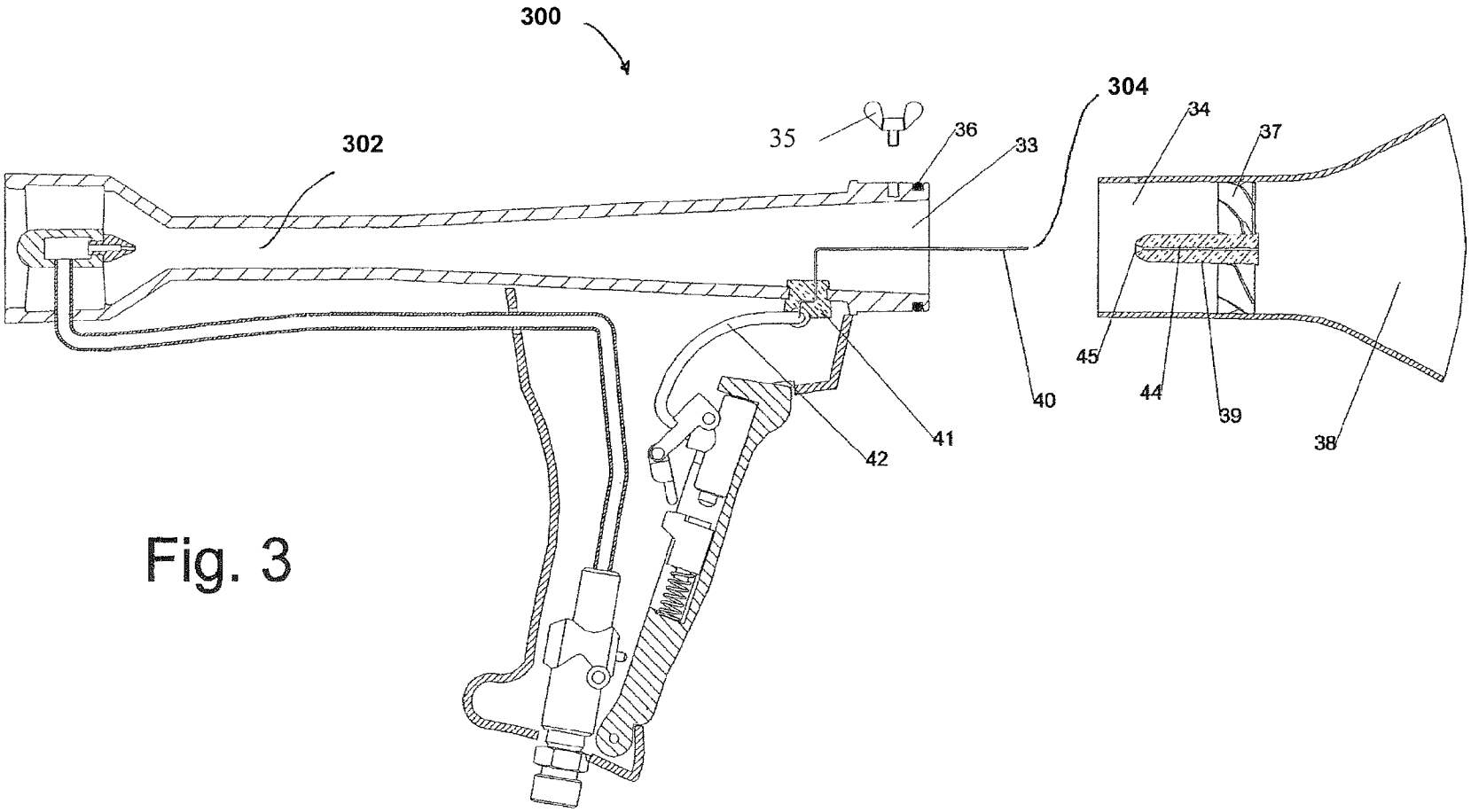
FIG. 3 is a cross-sectional exploded side view of an embodiment of a heat gun.

FIG. 3 shows an embodiment of a heat gun 300 with a burner chamber 38 fully disassembled from the pump 302. FIG. 3 shows electrode 40 with free tip end 304 extending from the end of the pump 302. When the burner chamber 38 is assembled onto the pump 302, the free tip end 304 of the electrode 40 is inserted through the insulator bore 44 (and counter bore 45) before the burner chamber 38 interfaces with the pump 302 at o-ring seal 36. Alternatively, the rear portion 34 of the burner chamber 38 may be lengthened such that the rear portion 34 interfaces with the o-ring seal 36 before the free tip end 304 of the electrode 40 interfaces with the insulator bore 44.

Figure 4:
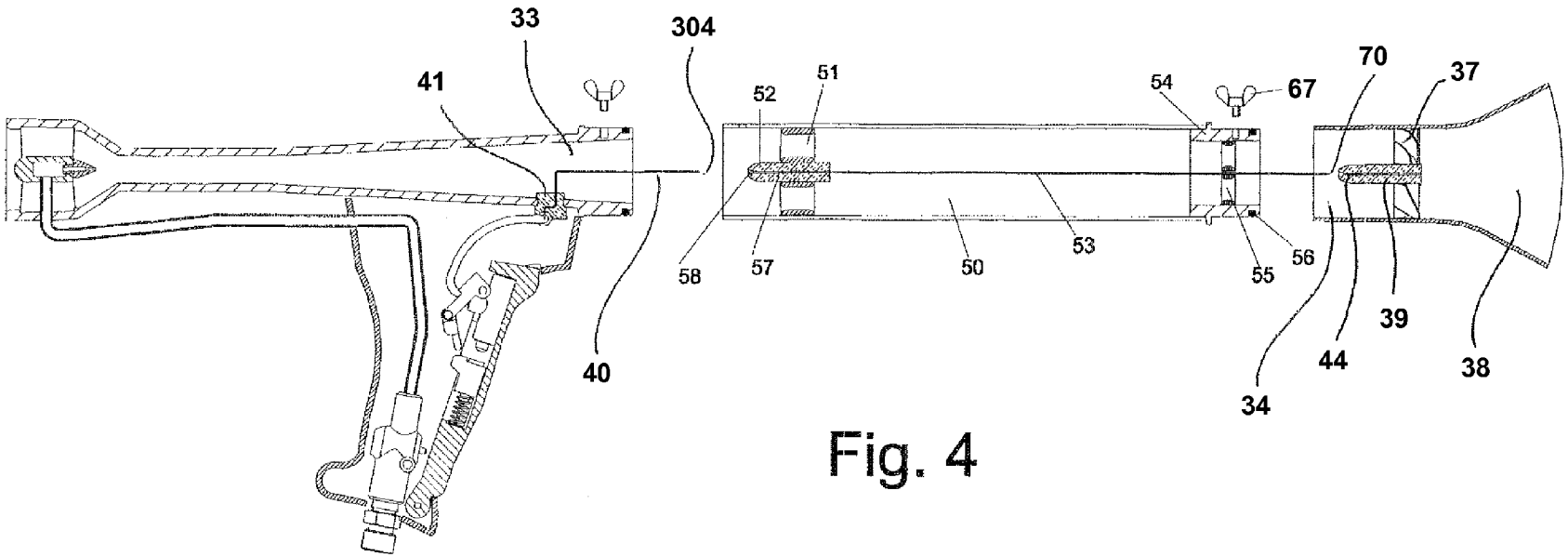
FIG. 4 is a cross-sectional exploded side view of an embodiment of a heat gun with an extension tube.

FIG. 4 shows an extension tube 50 for an embodiment of a heat gun according to an embodiment of the invention before its assembly. At the entry of the extension tube 50, an insulator 52 is mounted coaxially by means of struts 51. Insulator 52 is fashioned similar to insulator 39 with a central bore 57 and a tapered counter bore 58. An electrode 53 is mounted inside the bore 57 and leads to the outlet hub 54 end of the extension tube 50, where it is held in place centrally by the insulated strut 55. Electrode 53 extends beyond the outlet hub 54 end of the extension tube 50 by the same amount as the electrode 40 extends beyond the pump outlet 33.

The outlet hub 54 is similar to the pump outlet 33 with an O-Ring seal 56 and a quick-connect fastener 67 so that it can mate with the burner inlet 34 of the burner chamber 38. When burner chamber 38 is mated to the extension tube 50 via the burner inlet 34, the electrode 53 in the extension tube 50 fits through the bore 44 of the insulator 39 that is mounted centrally on the flame holder 37. The tip 70 of electrode 53 passes through the insulator 39 and extends into the burner chamber 38 downstream of the flame holder 37.

Figure 5:
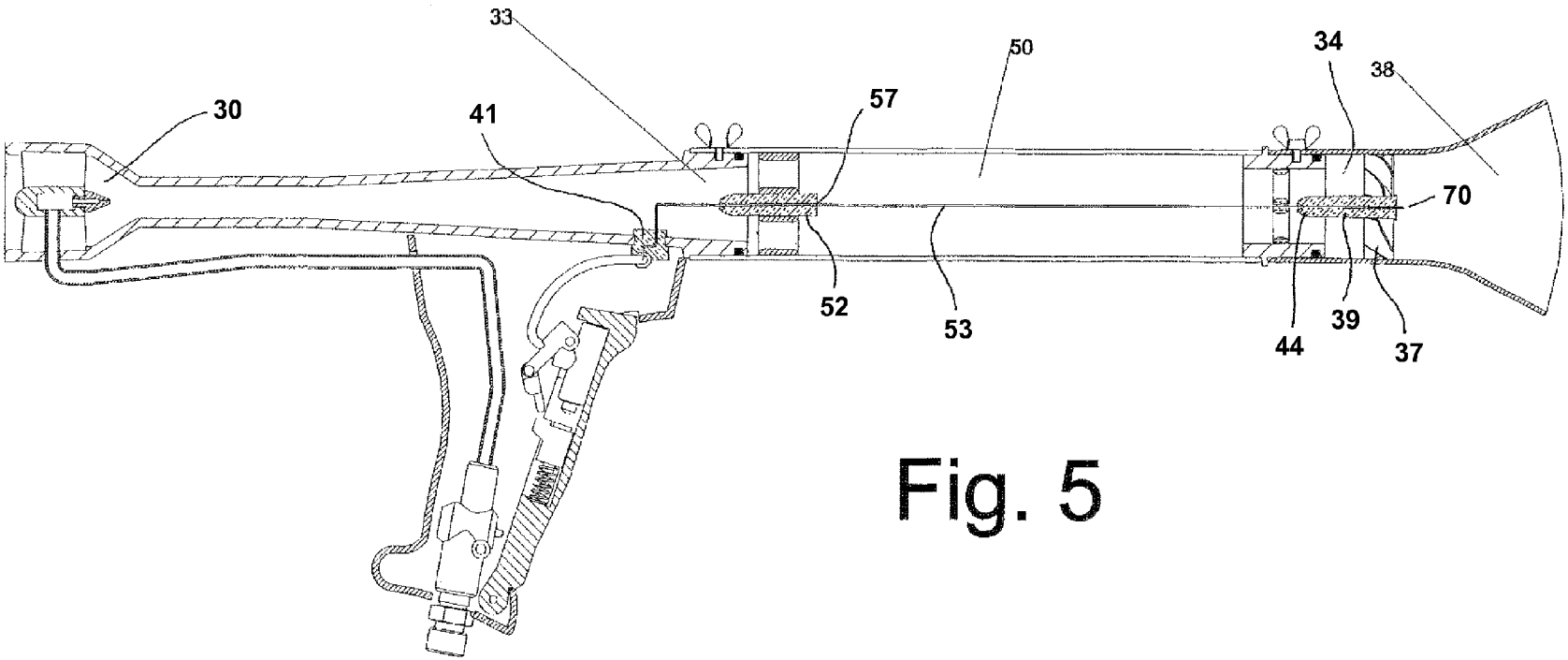
FIG. 5 is a cross-sectional side view of an embodiment of a heat gun with an extension tube.

FIG. 5 shows a heat gun according to an embodiment of the present invention with a pump 33, an extension tube 50, and a burner chamber 38 fully assembled. The extension tube 50 extends the length of the pump outlet hub 33 to the burner chamber 38. In the fully-assembled state, the free tip end (not shown in FIG. 5, but see 304 in FIG. 4) of electrode 40 presses against a tip end (not shown) of electrode 53 in the bore 57 of insulator 52. In an embodiment, electrode 40 and electrode 53 interfere when the extension tube 50 is in the fully-assembled state. Electrode 40 is configured to flex slightly in the direction of the bell shaped inlet 30 in response to this interference. This flexing has a spring force effect, which maintains the tip ends (not shown) of electrodes 40 and 53 in contact when the extension tube 50 is in the fully-assembled state. The added pump length resulting from the extension tube 50 compared to a heat gun without an extension tube may cause the air/fuel mixture to take a longer amount of time to reach the burner chamber 38. As a result, the igniter may have to create a spark for a longer period of time or be timed differently with respect to opening of the fuel valve as a result of a trigger pull.

Figure 6:
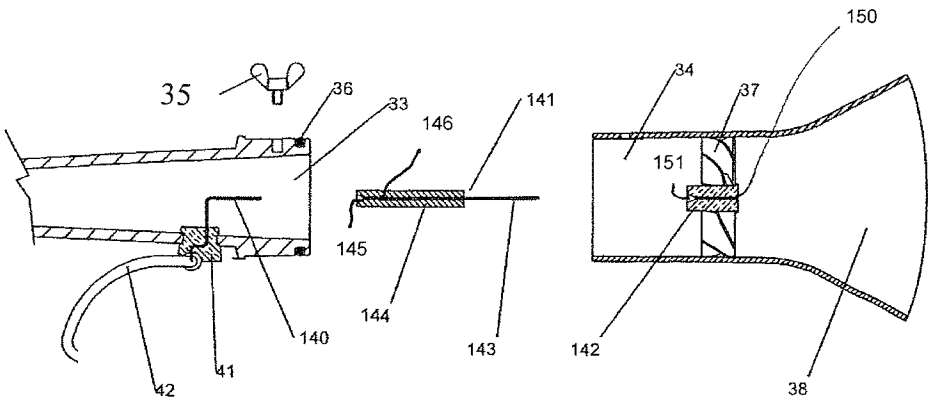
FIG. 6 is a cross-sectional side view of an embodiment of a heat gun with an intermediate member between a short lead and a short insulator.

FIG. 6 shows a heat gun according to an embodiment of the present invention, before its assembly, wherein the lead 140 in the pump outlet hub 33 is shorter than in other embodiments. Also, the insulator 142 in the burner chamber 38 of the embodiment in FIG. 6 is shorter than in other embodiments. The embodiment of FIG. 6 includes an intermediate member 141 that includes an intermediate electrode 143 and a tubular portion 144. The tubular portion 144 includes a bore 146 and counter bore 145.

When a heat gun according to the embodiment of FIG. 6 is assembled, the bore 146 and counter bore 145 are installed over the end of lead 140 such that an end of electrode 143 makes electrical contact with the lead 140. The opposite end of electrode 143 passes through a bore 150 and counter bore 151 in insulator 142 when the burner chamber is installed on the pump outlet hub 33.

In operation, depressing the trigger 24 opens the valve 22 which sends pressurized gas to the nozzle 26. The gas jet emanating from the nozzle 26 draws ambient air through the air inlet 29. The gas and air mix in the mixing section 31 and the mixture is then pressurized in the diffuser 32. As the trigger 24 is depressed further, it activates the piezo-electric igniter 23, which sends a high voltage spike of electricity up through the lead 42 to the electrode 40 and creates a spark S at the tip of the electrode 40 that protrudes into the burner chamber 38, igniting the combustible mixture.

To install the extension tube 50, the burner chamber 38 has first to be removed as illustrated in FIGS. 2 and 3. The extension tube 53 is then mounted to the pump by first inserting the electrode 40 into the counter bore 59 of the insulator 52, then sliding the extension tube 53 over the pump outlet hub 33 and securing the joint with fastener 35. Then the burner chamber 38 is mounted to the outlet hub 54 of the extension tube 50. Again, the connection between the tip of the electrode 53 and the counter bore 44 of the insulator 39 is established first before the burner inlet 34 is inserted.

Disassembly proceeds in the reverse order.

While this invention has been particularly shown and described with references to example embodiments thereof, it will be understood by those skilled in the art that various changes in form and details may be made therein without departing from the scope of the invention encompassed by the appended claims.

What is claimed is:

1. An igniter for a portable gas-fired heat gun, comprising: a heat gun diffuser having a slender flexible electrode extending in a downstream direction along at least a portion of a heat gun diffuser, the electrode being affixed to the diffuser, an end of the electrode extending along a longitudinal axis with a tip terminating downstream of the diffuser, at least part of the electrode having a straight free end portion that extends along the longitudinal axis and a portion extending and mounted to the diffuser at a transverse direction to the longitudinal axis, and configured for flexing in an upstream direction with axial spring force effect, such that said at least straight free end portion that extends along the longitudinal axis can translate along the longitudinal axis; and a burner chamber assembly configured to be attached and removed from the heat gun diffuser, the burner chamber assembly including a flame holder and an insulator with an electrically insulated bore therethrough constructed to accept the tip of the electrode which is removably slidably insertable completely therethrough in a downstream direction, the tip of the electrode extending downstream through the insulated bore into a burner chamber downstream of the flame holder when the burner chamber assembly is attached to the heat gun diffuser, a tapered counter bore of the insulator being located at an upstream end of the insulated bore and configured for facilitating insertion of the tip of the electrode into the insulated bore.

2. The igniter of claim 1 wherein the insulator is a ceramic insert fitted in the flame holder.

3. The igniter of claim 1 wherein the diffuser includes an extension tube configured to be attached to and removed from a heat gun body.

4. The igniter of claim 3 wherein the extension tube has an upstream end and a downstream end, the electrode comprising a first electrode extending from the heat gun body, and engaging a second electrode in the extension tube in a flexing manner with the spring force effect, the second electrode having an electrode tip protruding from the downstream end of the extension tube; and wherein the extension tube includes an extension tube insulator with an electrically insulated bore therethrough that couples to the end of the first electrode protruding from the heat gun body, the electrically insulated bore of the extension tube insulator electrically coupling the first electrode protruding from the heat gun body to the second electrode of the extension tube when the extension tube is attached to the heat gun body.

5. The igniter of claim 1 wherein the electrode is an intermediate electrode of an intermediate member, the intermediate member including a tubular portion having a bore for connecting to an igniter lead of the heat gun, the igniter lead being coupled to the diffuser and wherein an end of the igniter lead is configured to be inserted into the bore of the tubular portion of the intermediate member and to make electrical contact with the intermediate electrode.

6. A method of assembling a heat gun, comprising: providing a heat gun diffuser having a slender flexible electrode extending in a downstream direction along at least a portion of the heat gun diffuser, the electrode being affixed to the diffuser, an end of the electrode extending along a longitudinal axis carrying a tip terminating downstream of the diffuser, at least part of the electrode having a straight free end portion that extends along the longitudinal axis and a portion extending and mounted to the diffuser at a transverse direction to the longitudinal axis, and configured for flexing in an upstream direction with axial spring force effect, such that said at least straight free end portion that extends along the longitudinal axis can translate along the longitudinal axis; and mounting a burner chamber assembly to a downstream end of the heat gun diffuser, the burner chamber assembly including a flame holder and an insulator with an electrically insulated bore therethrough, the tip of the electrode removably slidably passing completely through the electrically insulated bore in a downstream direction with the tip of the electrode extending downstream through the insulated bore into a burner chamber downstream of the flame holder when the burner chamber assembly is mounted to the heat gun diffuser, a tapered counter bore of the insulator being located at an upstream end of the insulated bore and configured for facilitating insertion of the tip of the electrode into the insulated bore.

7. The method of claim 6 wherein the insulator is a ceramic insert fitted in the flame holder.

8. The method of claim 6 wherein the heat gun diffuser includes an extension tube with an upstream end and a downstream end, the electrode comprising a first electrode extending from the heat gun, and engaging a second electrode in the extension tube in a flexing manner with the spring force effect, the second electrode having an electrode tip terminating beyond the downstream end of the extension tube, the extension tube including an extension tube insulator with an electrically insulated bore therethrough; and further comprising attaching the extension tube to a heat gun body, the first electrode carried by the heat gun body passing through the electrically insulated bore of the extension tube insulator and electrically coupling the first electrode to the second electrode of the extension tube.

9. The method of claim 6 wherein the electrode is an intermediate electrode of an intermediate member, the intermediate member including a tubular portion having a bore for connecting to an igniter lead of the heat gun; and further comprising inserting an end of the igniter lead into the bore of the tubular portion of the intermediate member to make electrical contact with the intermediate electrode.

* * * * *